United States Patent [19]

Leech

[11] Patent Number: 5,011,541

[45] Date of Patent: Apr. 30, 1991

[54] CLEANING OF FOULED SPINNERET PARTS

[75] Inventor: Danny R. Leech, Waynesboro, Va.

[73] Assignee: E. I. Du Pont de Nemours and Company, Wilmington, Del.

[21] Appl. No.: 357,847

[22] Filed: May 30, 1989

[51] Int. Cl.[5] ..... B08B 3/00

[52] U.S. Cl. ..... 134/34; 134/25.1; 134/25.4; 134/32; 134/33

[58] Field of Search ..... 134/25.1, 25.4, 32, 134/33, 34, 199, 200, 148, 140, 144; 239/601, 602

[56] References Cited

U.S. PATENT DOCUMENTS 4,365,383 12/1982 Bartlett ..... 134/199
4,498,934 2/1985 Potts ..... 134/25.4
4,635,666 1/1987 Daley et al. ..... 134/199

OTHER PUBLICATIONS

*Fiber Producer,* vol. 5, No. 1, "Spinnerets: Selecting Steels and Cleaning Methods", pp. 22, 24, 26, 28, 30–31, 33–34, 55 (Feb. 1977).

L. A. Langley and Vincent Jelms, "A Study of Spinnerette Cleaning Practices", *Fiber Producer,* vol. 8, No. 1, pp. 35–36, 38, 40, 42, 62–63 (Feb. 1980).

*Primary Examiner*—Curtis R. Davis

[57] ABSTRACT

Fouled spinneret assembly parts are cleaned by impacting the fouled part with high-pressure jets of water. The water-jet cleaning treatment is especially effective for cleaning fouled spinnerets used in dry-spinning of spandex filaments.

4 Claims, 1 Drawing Sheet

CLEANING OF FOULED SPINNERET PARTS

BACKGROUND OF THE INVENTION

1. Field of the Invention

The present invention relates to a process for cleaning parts of spinneret assemblies that had become fouled during use in a synthetic organic filament production process and had to be removed from service. More particularly, the invention concerns such a process in which hydraulic jets are used to clean the fouled spinneret assembly parts for re-use in the filament production process.

2. Description of the Prior Art

In commercial processes for the manufacture of fibers from synthetic organic polymers by dry spinning, wet spinning, melt spinning, or the like, the fibers are formed by extrusion of polymer solutions or melted polymer through orifices of spinneret assemblies. In such extrusion operations, the orifices, as well as other parts of the spinneret assemblies, eventually become fouled with polymeric residues and/or inorganic particles. Such fouled assemblies cause difficulties in spinning continuity and product quality and therefore, must be removed from service.

Over the last several decades, various methods have been developed for cleaning fouled spinneret assemblies for re-use. *Fiber Producer*, v. 5, no. 1, "Spinnerets: Selecting Steels and Cleaning Methods", (February 1977) and *Fiber Producer*, v. 8, no. 1, L. A. Langley and V. Jelms, "A Study of Spinnerette Cleaning Practices" (February 1980) review the known methods. The methods include the use of anhydrous molten salt baths, acid baths (e.g., usually containing nitric acid) combustion, pyrolysis, fluidized bed furnaces, ultrasonics and the like, as well as various combinations of these methods. Although each of the methods has been used successfully, each has certain disadvantages. For example, baths of molten salts or acids are corrosive. Combustion, pyrolysis and high temperature fluidized-beds require careful temperature control. High temperatures can cause excessive local oxidation or distortion of a part. A process for cleaning fouled spinnerets of a commercial plant that produces dry-spun spandex currently employs a series of acid baths, rinses, and ultrasonic cleaning devices.

An object of the present invention is to provide an efficient, inexpensive and non-damaging alternative method for cleaning fouled parts of spinneret assemblies.

SUMMARY OF THE INVENTION

The present invention provides a process for cleaning parts of fouled spinneret assemblies. The process comprises impacting a fouled part with a substantially columnar jet of water for a time sufficient to remove polymeric and inorganic residues from the part, the water jet exiting from a nozzle located at a distance in the range of 0.5 to 10 centimeters from the surface of the part being cleaned, the nozzle having an exit orifice diameter in the range of 0.01 to 0.1 cm and the water being supplied at a pressure just upstream of the exit orifice in the range of 17,000 to 69,000 kiloPascals.

BRIEF DESCRIPTION OF THE DRAWINGS

The invention will be better understood by referring to the attached drawings wherein.

DETAILED DESCRIPTION OF PREFERRED EMBODIMENTS

Figure 1:
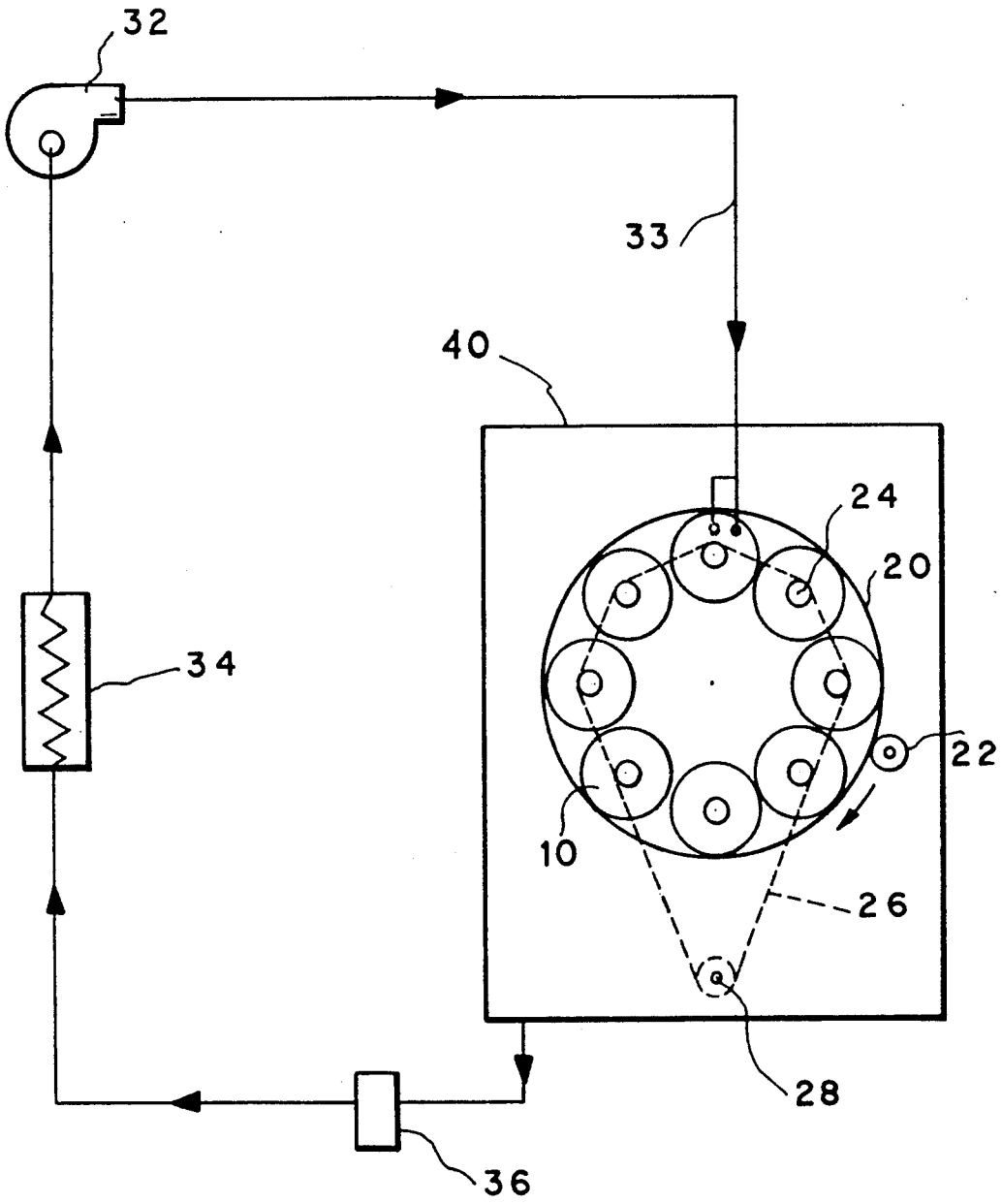
FIG. 1 is a schematic plan view of equipment suitable for carrying out the process of the invention and FIG. 2 is a more detailed side view of the equipment in the area of the nozzle and piece being cleaned.

The process of the present invention is suited for cleaning all types of spinneret assembly parts which become fouled during wet-spinning, dry-spinning or melt-spinning of synthetic organic fibers. The process is particularly useful for cleaning the fouled parts of spinneret assemblies used to dry spin filaments of spandex from a polymer solutions that also include various additives, such as titanium dioxide particles. A conventional spinneret assembly is disclosed in Dreibelbis et al, U.S. Pat. No. 4,679,998.

In accordance with the present invention, fouled spinneret assembly parts are cleaned by exposing the fouled surfaces of the parts to high pressure hydraulic jets. The fouled part needs to be exposed to the water jets only long enough for the fouling residues and deposits to be removed from the outer surfaces and passages of the part. Usually, the duration of the exposure to the hydraulic jets is at least 2 minutes. Exposure times of longer than about 20 minutes generally are are avoided. Short exposure times minimize the possibility of pitting of the metal part by the high energy water jets.

Although the fouled part can be cleaned with jets of cold water, more rapid cleaning is achieved if the water is hot (e.g., between about 50°–75° C.). Also, more efficient cleaning is achieved and if the fouled piece has been soaked in hot water prior to the hydraulic jet cleaning step. Soaking in hot water at temperatures of about 75°–95° C. apparently helps soften some of the organic residues.

In the cleaning process of the invention, the fouled part of a spinneret assembly that is to be cleaned is placed at a distance of about 0.5 to 10 cm from the exit of the water jet nozzle. The distance is not critical, so long as the water jet remains substantially columnar in nature. The preferred distance between the fouled piece and the nozzle exit is in the range 1 to 3 cm.

The exit orifice of the nozzle usually has a diameter in the range of 0.01 to 0.1 cm, preferably 0.05 to 0.08 cm. The water pressure just upstream of the exit orifice usually is in the range of 17,000 to 69,000 kiloPascals (2,500 to 10,000 psi). Although higher pressures can be employed satisfactorily, pressures in the range of 31,000 to 41,000 kPa (4,500 to 6,000 psi) are preferred.

Cleaning of fouled parts of spinneret assemblies by the method of the present invention provides safe, fast and effective removal of organic residues and of inorganic particulate deposits. The method also permits the use of broader range of materials for the various parts of the spinneret assembly. Parts no longer have to be made of only certain highly acid-resistant alloys. The use of acid cleaning baths can be eliminated. Cost savings and reductions in corrosion and abrasion damage to the cleaned parts are additional advantages that accompany use of the cleaning process of the invention.

The following Example, which describes a preferred embodiment of the process of the invention, is included for the purposes of illustration and is not intended to limit the scope of the invention, which is defined by the appended claims.

EXAMPLE

This example illustrates the cleaning of fouled spinneret disks by the process of the present invention. In this example, references are made to various parts of the apparatus depicted in the attached drawings and designated therein with numerals.

Spin assemblies that had been removed from service in a process for dry-spinning filaments of spandex polymer were disassembled into their various component parts (e.g., housings, O-rings, filter plates and spinneret disks, etc). The various parts were fouled with polymeric residues and with titanium dioxide deposits. Titanium dioxide deposits are particularly hard to remove. Conventional nitric acid baths do not satisfactorily remove such $TiO_2$ deposits. The stainless steel spinneret disks from the disassembled assemblies each measured about 9 inches (23 cm) in diameter and about ¼ inch (0.64 cm) in thickness and contained a multiplicity of spin orifices. Each orifice had an entrance diameter of about ⅛ inch (0.32 cm) and an outlet diameter of about 1/64 inch (0.04 cm). The number of spin orifices in the different spinneret disks ranged between about 60 and 200 per disk. Polymeric and titanium dioxide particulate residues were noted on spinneret plates and in some of the orifice passages.

Figure 2:
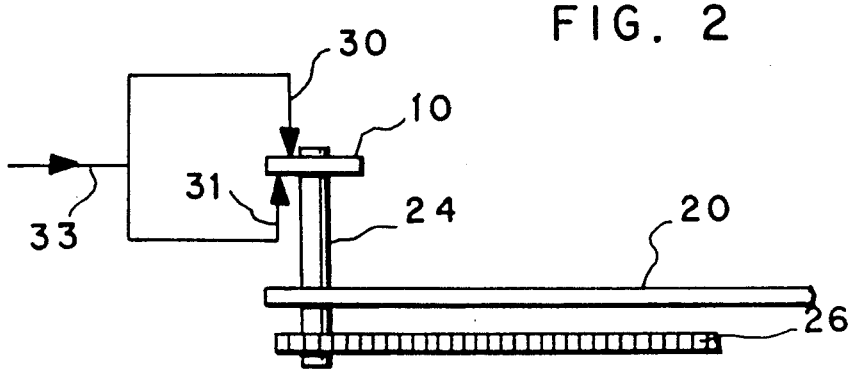

Twelve fouled spinneret disks were soaked in hot water overnight, removed from the water and then mounted in position on a cleaning apparatus of the type illustrated in FIGS. 1 and 2. The portion of the apparatus in which the hydraulic jets impact upon the parts being cleaned was contained in an enclosure 40 which is insulated to reduce noise and avoid excessive temperatures on the outer surfaces of the enclosure. The spinneret disks (designated 10 in the figures) were mounted near the outer circumference of a 3-foot (0.92-meter) diameter rotating table 20. A variable speed motor (not shown) rotated table 20 by means of drive shaft 22 which was peripherally connected to the outer edge of the table. The table rotated at a rate of one revolution every 80 minutes. Each spinneret disk was mounted and held in place on a separate spindle 24. Each spindle 24 was rotated at a rate of about 10 revolutions per minute by means of timing belt 26, which was driven by variable speed drive 28. As table 20 and spindles 24 are rotated, each spinneret disk 10 is forwarded to the cleaning position located between nozzles 30.

Nozzles 30, 31 were supplied by pump 32, through high pressure flexible hose 33, with water warmed to about 60° C. by heater 34. Supply pressure immediately upstream of the nozzle orifices was about 5,500 psi (38,000 kPa). A flow of about 2.3 gallons per minute (8.5 kg/min) through a 0.03-inch (0.076-cm) diameter exit orifice of each nozzle formed a substantially columnar jet of water which impacted upon the part being cleaned. The exit orifices of the nozzles 30, 31 were located about ¾ inch (1.95 cm) from the surface of the spinneret disk 10 being cleaned. The nozzles were mounted on means (not shown) that slowly reciprocated the nozzles toward and away from the center of spindle 24 so that the entire surface of the pieces being cleaned (i.e., spinneret disks 10) were impacted by the high-pressure water jets.

The cleaning water was recirculated after jetting upon the parts being cleaned. Any debris dislodged by the jets and carried away by the water was removed from the system by filter 36. In this manner, each spin disk was exposed to about a 5-minute cleaning treatment.

After the above-described cleaning treatment was performed, the jet-treated parts were soaked for about an hour in boiling water that contained a detergent (i.e., "Mr. Clean" sold by Procter and Gamble). The spinneret disks were then replaced in the cleaning apparatus and the cleaning treatment was repeated. Then, after a second soak in boiling water, the disks were dried, cooled and inspected under a 5X magnification. All polymeric residues and titanium dioxide particles had been removed. The disk surfaces and orifice passages were clean.

In a similar manner, other parts of the fouled spin assemblies were satisfactorily cleaned.

I claim:

1. A process for cleaning parts of fouled spinneret assemblies, wherein polymeric residues and inorganic particles deposited during the spinning of synthetic organic fibers are removed from the part, the process comprising, impacting a part of the fouled assembly with a substantially columnar jet of water for a time sufficient to remove the polymeric and inorganic residues from the part, the jet exiting from a nozzle being located at a distance in the range of 0.5 to 10 centimeters from the surface of the piece being cleaned, the nozzle having an exit orifice diameter in the range of 0.01 to 0.1 centimeter and the water being supplied at a pressure just upstream of the exit orifice in the range of 17,000 to 69,000 kiloPascals.

2. A process in accordance with claim 1 wherein the duration of the water-jet impacting treatment is at least 2 minutes, but no more than 20 minutes.

3. A process in accordance with claim 1 wherein the part to be cleaned is soaked in hot water before being impacted by the water jets.

4. A process in accordance with claim 1, 2 or 3 wherein the nozzle is located 1 to 3 cm from the surface of the part being cleaned, the exit orifice diameter is in the range of to 0.08 cm and the water supply pressure is in the range of 31,000 to 41,000 kPa.

* * * * *

UNITED STATES PATENT AND TRADEMARK OFFICE

CERTIFICATE OF CORRECTION

PATENT NO. : 5,011,541

DATED : April 30, 1991

INVENTOR(S) : Danny Rogers Leech

It is certified that error appears in the above-identified patent and that said Letters Patent is hereby corrected as shown below:

Claim 4, Col. 4, Line 53, after the word "of" insert --0.05--.

Signed and Sealed this

Ninth Day of February, 1993

*Attest:*

STEPHEN G. KUNIN

*Attesting Officer*

*Acting Commissioner of Patents and Trademarks*